US005857883A

United States Patent [19]

Knickerbocker et al.

[11] Patent Number: 5,857,883

[45] Date of Patent: Jan. 12, 1999

[54] METHOD OF FORMING PERFORATED METAL/FERRITE LAMINATED MAGNET

[75] Inventors: John U. Knickerbocker, Hopewell Junction; James N. Humenik, LaGrangeville, both of N.Y.; Andrew R. Knox, Kilbirnie, Scotland; Robert Rosenberg, Peekskill, N.Y.

[73] Assignee: International Business Machines Corporation, Armonk, N.Y.

[21] Appl. No.: 854,284

[22] Filed: May 9, 1997

[51] Int. Cl.[6] ..... H01J 9/02

[52] U.S. Cl. ..... 445/23

[58] Field of Search ..... 445/23, 37

[56] References Cited

U.S. PATENT DOCUMENTS

| | | | |
|---|---|---|---|
| 4,023,057 | 5/1977 | Meckling | 310/154 |
| 4,138,236 | 2/1979 | Haberey | 65/43 |
| 4,540,500 | 9/1985 | Torii et al. | 252/62.58 |
| 4,650,435 | 3/1987 | Tamutus | 445/37 |
| 5,599,413 | 2/1997 | Nakao et al. | 264/3.1 |

FOREIGN PATENT DOCUMENTS 2304981 3/1997 United Kingdom .

OTHER PUBLICATIONS

Patent Abstracts of Japan, Publication No. JP60093742, vol. 9, No. 240, Patentee: Matsushita Denki Sangyo KK, entitiled Display Device.

US. Application Serial No. 08/823,669, Beeteson filed Mar. 24, 1997.

*Primary Examiner*—Kenneth J. Ramsey

*Attorney, Agent, or Firm*—Aziz M. Ahsan

[57] ABSTRACT

The present invention relates generally to a new metal/ferrite laminate magnet and process thereof. More particularly, the invention encompasses a new process for fabrication of a large area laminate magnet with a significant number of perforated holes, integrated metal plate(s) and electrodes for electron and electron beam control. The present invention also relates to a magnetic matrix and electron beam source and methods of manufacture thereof.

30 Claims, 4 Drawing Sheets

METHOD OF FORMING PERFORATED METAL/FERRITE LAMINATED MAGNET

CROSS-REFERENCE TO RELATED PATENT APPLICATION

This Patent Application is related to U.S. patent application Ser. No. 08/854,285, filed on May 9, 1997, entitled "METAL/FERRITE LAMINATE MAGNET", assigned to the assignee of the instant Patent Application and the disclosure of which is incorporated herein by reference.

FIELD OF THE INVENTION

The present invention relates generally to a new metal/ferrite laminate magnet and process thereof. More particularly, the invention encompasses a new process for fabrication of a large area laminate magnet with a significant number of perforated holes, integrated metal plate(s) and electrodes for electron and electron beam control. The present invention also relates to a magnetic matrix and electron beam source and methods of manufacture thereof.

BACKGROUND OF THE INVENTION

A magnetic matrix display is particularly, although not exclusively, useful in display applications, especially flat panel display applications. Such flat panel display applications include television receivers, visual display units for computers, especially, although not exclusively, portable and/or desktop computers, personal organizers, communications equipment, wall monitor, and the like. Flat panel display devices based on a magnetic matrix electron beam source hereinafter may be referred to as Magnetic Matrix Displays (MMD).

Conventional flat panel displays, such as liquid crystal display panels, and field emission displays, provide one display technology. However, these conventional flat panel displays are complicated and costly to manufacture, because they involve a relatively high level of semiconductor fabrication, delicate materials, and high tolerance requirements.

U.S. patent application Ser. No. 08/695,856, filed on Aug. 9, 1996, entitled "ELECTRON SOURCE", which also corresponds to U.K. Patent Application Serial No. 2304981, assigned to the assignee of the instant Patent Application and the disclosure of which is incorporated herein by reference, discloses a magnetic matrix electron source and methods of manufacture thereof. Also disclosed is the application of the magnetic matrix electron source in display applications, such as, for example, flat panel display, displays for television receivers, visual display units for computers, to name a few. Also disclosed is a magnetic matrix display having a cathode for emitting electrons, a permanent magnet with a two dimensional array of channels extending between opposite poles of the magnet, the direction of magnetization being from the surface facing the cathode to the opposing surface. The magnet generates, in each channel, a magnetic field for directing electrons from the cathode means into an electron beam. The display also has a screen for receiving the electron beam from each channel. The screen has a phosphor coating facing the side of the magnet remote from the cathode, the phosphor coating comprising a plurality of pixels each corresponding to a different channel. There are grid electrode means disposed between the cathode means and the magnet for controlling the flow of electrons from the cathode means into each channel. The two dimensional array of channels are regularly spaced on an X-Y grid. The magnet area is large compared with its thickness. The flat panel display devices based on a magnetic matrix electron source is also referred in the industry as MMD (Magnetic Matrix Display).

The permanent magnet is used to form substantially linear, high intensity fields in the channels or magnetic apertures for the purpose of collimating the electrons passing through the aperture. The permanent magnet is insulating, or at most, has a small conductivity, so as to allow a field gradient along the length of the aperture. The placement of the beam so formed, on the phosphor coating, is largely dependent on the physical location of the apertures in the permanent magnet.

In operation, these electron beams are directed at a phosphor screen and collision of the electron beam with the phosphor results in light output, the intensity being proportional to the incident beam current (for a fixed final anode voltage). For color displays, three different colored phosphors (such as red, green and blue) are used and color is obtained by selective mixing of these three primary colors.

For accurate color reproduction, the location of the electron beams on the appropriate colored phosphor is essential.

Some degree of error may be tolerated by using "black matrix" to separate the different phosphors. This material acts to delimit individual phosphor colors and also enhances the contrast ratio of the displayed image by making the display faceplate appear darker. However, if the electron beam is misplaced relative to the phosphor, initially the light output from the phosphor is reduced (due to loss of beam current to the black matrix) and this will be visible as a luminance non-uniformity. If the beam is subject to a more severe placement error, it may stray onto a different colored phosphor to that for which it was intended and start to produce visible quantities of light output. Thus the misplaced electron beam is actually producing the wrong light output color. This is called a purity error and is a most undesirable display artifact. For a 0.3 mm pixel, typical phosphor widths are 67 $\mu$m with 33 $\mu$m black matrix between them.

It will be apparent that a very precise alignment is required between the magnet used to form the electron beams and the glass plate used to carry the phosphors that receive the electron beams. Further, this precise alignment must be maintained over a range of different operating conditions (high and low brightness, variable ambient temperature etc).

A number of other magnet characteristics are also important when considering application for a display, such as, for example:

1. It is generally accepted that the displayed image is formed by a regular array of pixels. These pixels are conventionally placed on a square or rectangular grid. In order to retain compatibility with graphics adaptors the magnet must thus present the electron beams on such an array.
2. In operation, the spacing between the grids used for bias and modulation of the electron beam and the electron source determines the current carried in the electron beam. Variations of this spacing will lead to variations in beam current and so to changes in light output from the phosphor screen. Hence it is a requirement that the magnet, which is used as a carrier for these bias and modulation grids, maintain a known spacing to the electron source. To avoid constructional difficulties, the magnet should be flat.
3. The display will be subject to mechanical forces, especially during shipment. The magnet must retain structural integrity over the allowable range of stresses it may encounter. A commonly accepted level is an equivalent acceleration of 30 G (294 $ms^{-2}$).

One further requirement is that since the magnet is to be used within the display, which is evacuated, it should not contain any organic components which may be released over the life of the display, so degrading the quality of vacuum or poisoning the cathode.

Finally, the magnet is magnetized in the direction of the apertures, that is the poles correspond to the faces of the magnet.

The manufacture of such a magnet that satisfies the above conditions is not possible by the use of previously known manufacturing methods. Certainly a magnet (ferrite, for example) of the desired size without apertures is readily obtainable but the presence of the apertures causes some problems.

If the apertures in the magnet are to be formed after the ferrite plate has been sintered, either laser or mechanical drilling may be used. However, the sintered ferrite is a very hard material and forming the apertures by this technique will be a costly and lengthy process—unsuitable for a manufacturing process.

Holes could be formed in the ferrite at the greensheet stage before sintering by known punching/drilling methods typical of multi-layer ceramics for microelectronics applications. However, during sintering a number of problems would be anticipated, such as, for example:

1. The magnet plate will be subject to uneven shrinkage leading to the holes "moving"—an unequal radial displacement from their nominal positions.
2. The magnet itself is likely to "bow" such that it forms a section of a large diameter sphere.
3. Cracking is likely to occur between adjacent apertures due to the apertures acting as stress concentrators.
4. If, to obtain the desired aperture length, multiple thin sheets are stacked on top of one another, misalignment may occur in stacking which could lead to no "line of sight" through the apertures.

A further problem is that ferrite is a hard but not tough material and the presence of the apertures significantly reduces the mechanical strength of the plate. Thus, during shipment when large shocks may be encountered, complete mechanical failure of the magnet is a distinct possibility.

U.S. Pat. No. 4,138,236 discloses a method of bonding hard and/or soft magnetic ferrite parts with an oxide glass. The oxide glass may be applied prior to or after pre-firing or main firing. Finally, the ferrite parts are fused at temperatures in excess of the glass softening point.

U.S. Pat. No. 4,540,500 discloses a low temperature sinterable oxide magnetic material prepared by adding 0.1 to 5 percent by weight of glass to ferrite. In some situations, the sintering temperature can be reduced to about 1,000° C. or less.

U.S. Pat. No. 4,023,057 discloses a compound magnet for a motor stator having a laminated structure that includes thin, flexible magnets made from permanently magnetizable particles, such as barium ferrite, that are embedded in a flexible matrix, such as rubber. Various laminated arrangements are contemplated for producing more intense magnetic fields and thin metal spacers are used in most laminated structures to collapse the respective fields of the flexible magnetic components to increase the flux density at the resultant poles and to orient the permanent magnetic fields in the magnetic circuit of the motor.

Published Japanese Patent Application No. JP60093742 discloses a display having a focus electrode with a conductive magnetic body and a sputtered metal coating on one surface of the magnet body. The conductivity is required for the focusing electrode to perform its function. The coating is sputtered and so is a thin coating, not substantially adding to the mechanical structure of the magnet. Each of the holes in the magnet has a number of electron beams passing through it.

U.S. patent application Ser. No. 08/823,669, filed on Mar. 24, 1997, entitled "MAGNET AND METHOD FOR MANUFACTURING A MAGNET", assigned to the assignee of the instant Patent Application and the disclosure of which is incorporated herein by reference, discloses a magnet-photosensitive glass composite and methods thereof.

However, the prior art does not disclose or teach the metal/ferrite laminate magnet and process thereof of the present invention.

PURPOSES AND SUMMARY OF THE INVENTION

The invention is a novel structure and process for metal/magnetic media (e.g. ferrite) laminate magnets.

Therefore, one purpose of this invention is to provide a structure and a process that will provide as the preferred embodiment metal/ferrite laminate magnets.

Another purpose of this invention is to provide for a mask to create a glass plate with multi-phosphors (red, green, blue) which receives an electron beam to create a display.

Still another purpose of this invention is to provide a structure through which one or more collimated beam(s) of electrons can be achieved using a magnetic laminate.

Yet another purpose of this invention is to provide a structure that can be used with any electron sensitive process.

Still yet another purpose of the invention is to provide a laminated metal/ferrite magnet that has a plurality of openings for guiding electrons and/or electron beams.

Therefore, in one aspect this invention comprises a process of forming metal/ferrite laminate magnet, comprising the steps of:

(a) forming at least one opening in a metal sheet having a first surface and a second surface, (b) securing at least one ferritic layer to said first surface of said metal sheet, (c) securing at least one dielectric layer to said second surface of said metal sheet, (d) forming an opening through said ferritic layer and said dielectric layer, such that at least a portion of said opening overlaps a portion of said opening in said metal sheet, and thereby forming said metal/ferrite laminate magnet.

In another aspect this invention comprises an electron source, comprising, at least one cathode means and at least one metal/ferrite laminate magnet, wherein said magnet has a plurality of magnetic channels extending between opposite poles of said magnet, wherein each magnetic channel allows the flow of electrons received from said cathode means into an electron beam towards a target.

BRIEF DESCRIPTION OF THE DRAWINGS

The features of the invention believed to be novel and the elements characteristic of the invention are set forth with particularity in the appended claims. The drawings are for illustration purposes only and are not drawn to scale.

Furthermore, like numbers represent like features in the drawings. The invention itself, however, both as to organization and method of operation, may best be understood by reference to the detailed description which follows taken in conjunction with the accompanying drawings in which.

DETAILED DESCRIPTION OF THE INVENTION

Figure 1:
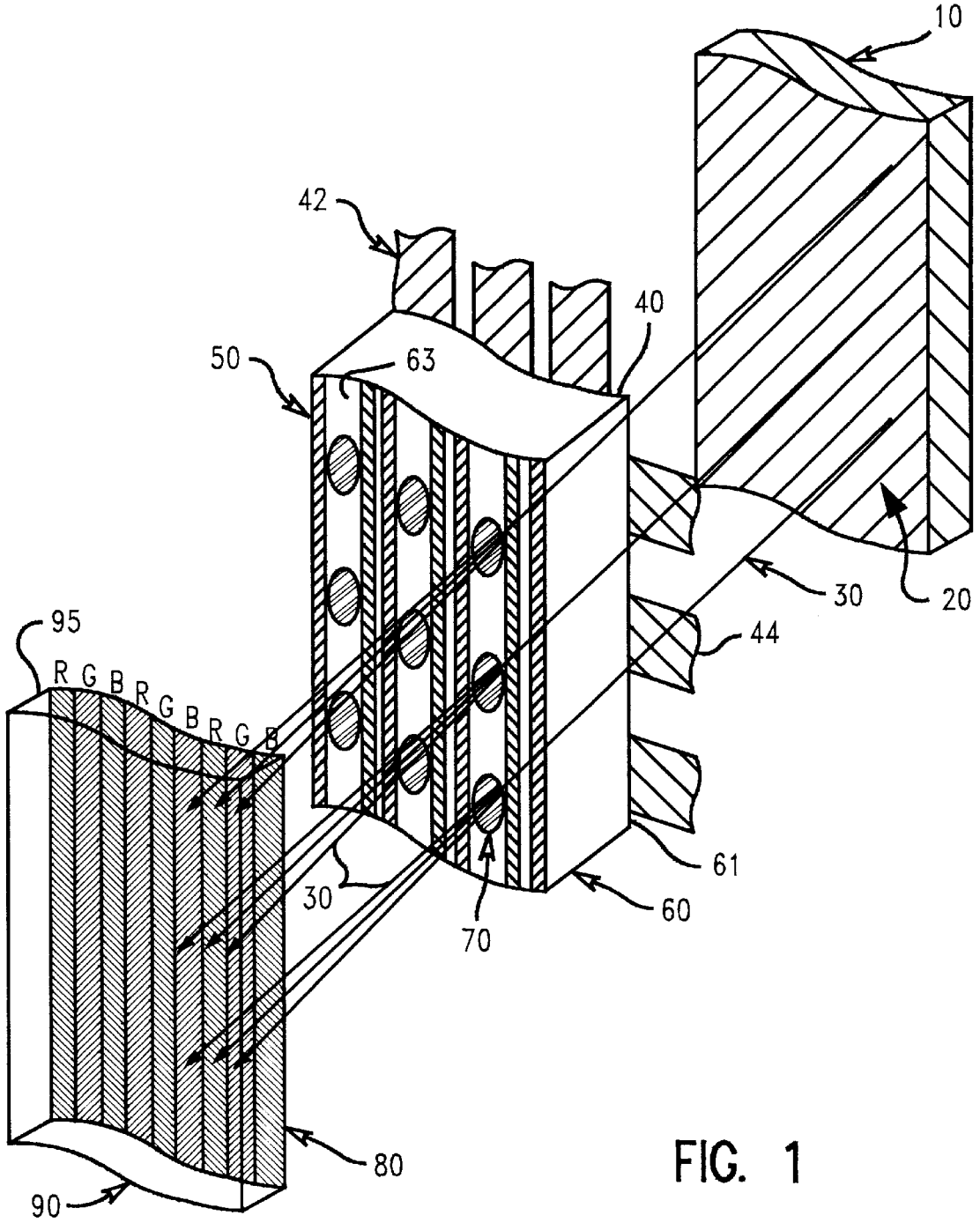
FIG. 1, illustrates a preferred embodiment of this invention where a metal/ferrite laminate magnet is directing an electron beam from a cathode to a display panel.

In accordance with the present invention, there is provided an electron source comprising cathode means and a laminated magnet. The laminated magnet is perforated by a plurality of channels extending between opposite poles of the magnet, wherein each channel can direct or guide electrons received from the cathode means into an electron beam towards a target.

In a preferred embodiment of the present invention, the electron source comprises grid electrode means disposed between the cathode means and the magnet for controlling flow of electrons from the cathode means into the magnetic channels.

The magnetic channels are preferably disposed in the magnet in a two dimensional array of rows and columns.

Preferably, the grid electrode means comprises a plurality of parallel row conductors and a plurality of parallel column conductors arranged orthogonally to, and insulated from, the row conductors, each channel being located at a different intersection of a row conductor and a column conductor.

The grid electrode means may be disposed on the surface of the cathode means facing the magnet. Alternatively, the grid electrode means may be disposed on the surface of the magnet facing the cathode means.

The cathode means may comprise a cold emission device such as a field emission device. Alternatively, the cathode means may comprise a photocathode. In some embodiments of the present invention, the cathode may comprise a thermionic emission device.

In a particularly preferred embodiment of the invention, each channel may have a cross-section which varies in shape and/or area along its length.

In a preferred embodiment of the present invention, each channel may be tapered, the end of the channel having the largest surface area facing the cathode means.

The laminated magnet preferably comprises ferrite. In some embodiments of the present invention, the magnet may comprise a ceramic material. In preferred embodiments of the present invention, the magnet may also comprise a binder. The binder may be organic or inorganic. Preferably, the binder comprises an inorganic glass composite containing glass forming oxides for optimized properties in fabrication and use.

In preferred embodiments of the present invention, the channel is circular in cross-section. In other embodiments of the present invention, the cross-section of the channel could be either rectangular or polygonal. The corners and edges of each channel could also be chamfered or radiussed.

The magnet may comprise a stack of perforated laminations, the perforations in each lamination being aligned with the perforations in an adjacent lamination to continue the channel through the stack, the laminated stack being arranged such that like poles of the laminations face each other. Spacers may be inserted between the laminations to give the stack an improved lens effect.

An insulating layer may be deposited on at least one surface of the magnet to reduce flashovers.

Preferred embodiments of the present invention comprise anode means disposed on the surface of the magnet remote from the cathode for deflecting electrons emerging from the channels.

The anode means preferably comprises a plurality of anodes extending parallel to the columns of channels, the anodes comprising pairs of anodes each corresponding to a different column of channels, each pair comprising first and second anodes respectively extending along opposite sides of the corresponding column of anodes, the first anodes being interconnected and the second anodes being interconnected. Preferably, the anodes partially surround the channels.

Particularly preferred embodiments of the present invention comprise means for applying a deflection voltage across the first and second anodes to deflect electron beams emerging from the channels.

The present invention in one aspect is a display device comprising: an electron source of the kind hereinbefore described; a screen for receiving electrons from the electron source, the screen having a phosphor coating facing the side of the magnet remote from the cathode; and means for supplying control signals to the grid electrode means and the anode means to selectively control flow of electrons from the cathode to the phosphor coating via the channels thereby producing an image on the screen; and means for supplying a voltage gradient across the magnet to accelerate the electrons in the channels; and a means of accelerating electrons to the phosphor screen at the required voltage.

The present invention in another aspect is a display device comprising: an electron source of the kind hereinbefore described; a screen for receiving electrons form the electron source, the screen having a phosphor coating facing the side of the magnet remote from the cathode, the phosphor coating comprising a plurality of groups of different phosphors, the groups being arranged in a repetitive pattern, each group corresponding to a different channel; means for supplying control signals to the grid electrode means and the anode means to selectively control flow of electrons from the cathode to the phosphor coating via the channels; and deflection means for supplying deflection signals to the anode means to sequentially address electrons emerging from the channels to the appropriate phosphor of the phosphor group thereby to produce a color image on the screen. The phosphor group preferably comprise Red, Green, and Blue phosphors.

The deflection means is preferably arranged to address electrons emerging from the channels to the appropriate phosphors in the repetitive sequence Red, Green, Blue, Red, . . . or Red, Green, Red, Blue . . . . Alternatively, the deflection means may be arranged to address electrons emerging from the channels to the appropriate phosphors in the repetitive sequence Red, Green, Blue, Red, . . . or Red, Green, Red, Blue, . . . .

Preferred examples of display devices of the present invention comprise a final anode layer disposed on the magnet plate closest to the phosphor coating.

The screen may be arcuate in at least one direction and each interconnection between adjacent first anodes and between adjacent second anodes comprises a resistive element.

Particularly preferred examples of display devices of the present invention comprise means for dynamically varying a DC level applied to the anode means to align electrons emerging from the magnetic channels with the phosphor coating on the screen.

Some example of the display devices of the present invention may comprise an aluminum backing adjacent to the phosphor coating.

It will be appreciated that the present invention extends to a computer system comprising: memory means; data transfer means for transferring data to and from the memory means; processor means for processing data stored in the memory means; and a display device comprising the electron source as hereinbefore described for displaying data processed by the processor means.

It will further be appreciated that the present invention extends to a print-head comprising an electron source as hereinbefore described. Still further, it will be appreciated that the present invention extends to document processing apparatus comprising such a print-head, together with means for supplying data to the print-head to produce a printed record in dependence on the data.

The present invention in yet another aspect is a triode device comprising: cathode means; a laminated magnet perforated by a plurality of channels extending between opposite poles of the magnet wherein each channel forms electrons received from the cathode means into an electron beam; grid electrode means disposed between the cathode means and the magnet for controlling flow of electrons from the cathode means into the channels; and, anode means disposed on the surface of the magnet remote from the cathode for accelerating electrons through the channels towards the glass plate containing phosphors.

The present invention from still another aspect is a process for making an electron beam collimator, comprising: forming perforated metal plates, perforated greensheets of dielectric and ferrite containing compositions, forming metal electrode conductors and composite magnetic structure to produce a laminated magnet with desired characteristics.

The process may comprise mixing the ferrite with a binder prior to forming the powder layer. Preferably, the binder comprises glass particles.

The process may comprise depositing anode means on a perforated face of the magnet.

Preferably, the process comprises depositing control grid means on the face of the magnet remote from the face carrying the anode means.

At least one of the steps of depositing the anode means and the steps of depositing the control grid means may comprise photolithography. Alternatively, plating, screen printing or decal transfer may be used for depositing anode means and control grid means.

The present invention from still another aspect is a process for making a display device comprising: making an electron source according to the process hereinbefore described; positioning a phosphor coated screen adjacent the face of the magnet carrying the anode means; and, evacuating spaces between the cathode means and between the magnet and the magnet and the screen.

The present invention from yet another aspect is a process for addressing pixels of a display screen having a plurality of pixels, each pixel having successively first, second, and third sub-pixels in line, the process comprising: generating a plurality of electron beams, each electron beam corresponding to a different one of the pixels; and, deflecting each electron beam to repetitively address the sub-pixels of the corresponding pixel in the sequence second pixel, first pixel, second pixel, third pixel.

Referring now to the figures, such as, FIG. 1, a color magnetic matrix display of the present invention comprises: a first plate 10, such as, a glass plate 10, carrying a cathode 20, and a second plate 90, such as, a glass plate 90, carrying at least one coating of at least one phosphor pixel or dots or stripes 80, such as, sequentially arranged red, green and blue phosphor stripes 80, facing the cathode 20. The phosphor stripes 80, are preferably high voltage phosphors. A final anode layer 95, is disposed on the phosphor coating 80.

A laminated magnet 60, is disposed between glass plates 90 and 10. The magnet 60, having a bottom or first surface 61, and a top surface or second surface 63, is perforated by a two dimension matrix of perforation or "pixel wells" 70.

An array of anodes 50, are formed on the surface of the magnet 60, facing the phosphor stripes 80. For the purposes of explanation of the operation of the display, this surface 63, will be referred to as the top of the magnet 60. There is a pair of anodes 50 associated with each column of the matrix of pixel wells 70. The anode of each pair extend along opposite sides of the corresponding column of pixel wells 70. A control grid 40, is formed on the surface of the magnet 60, facing the cathode 20. For the purposes of explanation of the operation of the display, this surface 61, will be referred to as the bottom of the magnet 60.

The control grid 40, comprises a first group of parallel control grid conductors 42, extending across the magnet surface 61, in a column direction, and a second group of parallel control grid conductors 44, extending across the magnet surface 61, in a row direction so that each pixel well 70, is situated at the intersection of different combination of a row grid conductor 44, and a column grid conductor 42. As will be described later, plates 10 and 90, and magnet 60, are brought together, sealed and then the whole assembly is evacuated.

Figure 10:
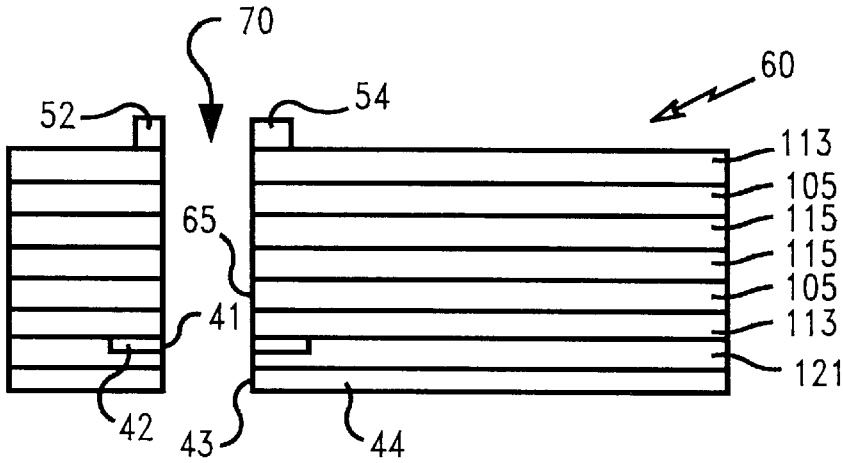

In operation, electrons are released from the cathode 20, forming an electron beam 30, and are attracted towards control grid 40. Control grid 40, provides a row/column matrix addressing mechanism for selectively admitting electrons to each pixel well 70. Electron beam 30, passes through the grid 40, into an addressed pixel well 70. In each pixel well 70, there is a magnetic field. As shown in FIG. 10, the metal plate 105, at the top of pixel well 70, accelerates the electrons through pixel well 70, and the pair of anodes 50, provide selective sideways deflection of the emerging electron beam 30. Electron beam 30, is then accelerated towards a higher voltage anode formed on glass plate 90, to produce a high velocity electron beam 30, having sufficient energy to penetrate the anode and reach the underlying phosphors 80, resulting in light output. The higher voltage anode may typically be held at 10 kV.

For the purpose of the above calculations, anodes 50, were assumed to be at the same potential as phosphors 80, so that there is a constant electric field between the two. This arrangement is acceptable if low voltage phosphors are used. However, in preferred embodiments of the present invention, high voltage phosphors are used, requiring the final anode 95, to be at a much higher potential than deflection anodes 50. Thus electron beam 30, will continue to accelerate towards the final anode 95, after leaving the vicinity of anodes 50. This in turn causes a change in the path of the electron beam 30, before it hits phosphor 80. The accelerating electric field between anodes 50, and the final anode 95, reduces the deflection effect of anodes 50. Therefore, the length of anodes 50, can be increased without risk of significant numbers of electrons colliding with them. This reduces the susceptibility of the display to manufacturing tolerances during deflection anode fabrication.

Returning now to FIG. 1, and magnet 60, in particular, as mentioned earlier, perforations 70, in magnet 60, allow the closing of flux lines, thus providing magnetic fields within pixel well 70. It is desirable for magnet 60, to be relatively cheap to construct; to be non-conductive, thereby allowing it to form a substrate for conductive track fabrication; to be mechanically robust; to be thermally stable; not to be too massive; and, to be amenable to fabrication to overall display dimensions.

At least some of the above properties may be met by magnet 60, being formed from laminated ferritic material.

As mentioned earlier, the display has cathode means 20, grid or gate electrodes 40, and an anode 50. The arrangement can thus be regarded as a triode structure. Electron flow from cathode means 20, is regulated by grid 40, thereby controlling the current flowing to the anode 50. It should be noted that the brightness of the display depends on both the velocity and the number of electrons 30, striking the phosphor 80. Typically, the final anode 95, is held at a contant potential (say about 10 KV), and the acceleration of the electrons towards this potential gives them sufficient energy to ensure adequate photon emission from the phosphor 80, i.e., an energy conversion process.

As mentioned above, magnet 60, acts as a substrate onto which the various conductors required to form the triode are deposited. Deflection anodes 50, are deposited on the top surface 63, of magnet 60, and control grid 40, is fabricated on the bottom surface 61, of the magnet 60. It will be appreciated that the dimensions of these conductors are relatively large compared with those employed in current flat panel technologies, such as, for example, liquid crystal or field emission displays. The conductors may advantageously be deposited on magnet 60, by any of a number of conventional thick film or thin film techniques.

Cathode means 20, may include an array of field emission tips or field emission sheet emitters (amorphous diamond or silicon for example). In such cases, the control grid 40, may be formed on the field emission device substrate. Alternatively, cathode means 20, may include plasma or hot area cathodes, in which cases control grid 40, may be formed on the bottom surface 61, of the magnet as hereinbefore described. An advantage of the ferrite composite magnet is that the ferrite composite can act as a carrier and support for all the structures of the display that need precision alignment.

In yet another alternative embodiment of the present invention, cathode means 20, comprises a photocathode.

As mentioned above, control grid 40, controls the beam current and hence the brightness. In some embodiments of the present invention. The display may be responsive to digital video alone, i.e., pixels either on or off with no grey scale. In such cases, a single grid 40, provides adequate control of beam current. The application of such displays are however limited and, generally, some form of analog, or grey scale, control is desirable. Thus, in other embodiments of the present invention, two grids are provided; one for setting the black level or biasing, and the other for setting the brightness of the individual pixels. Such a double grid arrangement may also perform matrix addressing of pixels where it may be difficult to modulate the cathode.

A display of the present invention differs from a conventional CRT display in that, whereas in a CRT display only one pixel at a time is lit, in a display of the present invention a whole row or column is lit. Another benefit of the display of the present invention resides in the utilization of row and column drivers. Whereas a typical LCD requires a driver for each of the Red, Green and Blue channels of the display, a display of the present invention uses a single pixel well 70, (and hence grid) for all three colors. Combined with the aforementioned beam-indexing, this means that the driver requirement is reduced by a factor of 3 relative to a comparable LCD. A further advantage is that, in active LCDs, conductive tracks must pass between semiconductor switches fabricated on the screen. Since the tracks do not emit light, their size must be limited so as not to be visible to a user. In displays of the present invention, all tracks are hidden either beneath phosphor 80, or on the underside of magnet 60. Due to the relatively large spaces between adjacent pixel wells 70, the tracks can be made relatively large. Hence capacitance effects can be easily overcome.

The relative efficiencies of phosphors 80, at least partially determines the drive characteristics of the gate structure. One way to reduce the voltages involved in operating a beam indexed system is to change the scanning convention. In a preferred embodiment of the present invention, rather than the usual scan of R G B R G B . . . , the scan is organized so that the most inefficient phosphor is placed in between the two more efficient phosphors in a phosphor stripe pattern. Thus, if the most inefficient phosphor is, for example, Red, the scan follows the pattern B R G R B R G R . . . .

In a preferred embodiment of the resent invention, a standing DC potential difference is introduced across deflection anodes 50. The potential can be varied by potentiometer adjustment to permit correction of any residual misalignment between phosphors 80, and pixel wells 70. A two dimensional misalignment can be compensated by applying a varying modulation as the row scan proceeds from top to bottom.

As hereinbefore described, a preferred embodiment of the present invention involves a pixel addressing technique which differs from those employed in both CRT and LCD technologies. In conventional CRT displays, pixels are addressed by scanning an electron beam horizontally for a line of data and vertically for successive data lines. The actual period of phosphor excitation for single pixel is very short and the duration between successive excitations long, i.e., the frame rate of the display. Thus the light output from each pixel is limited. Grey scale is achieved by varying the beam current density. In conventional active matrix LCDS, each pixel consists of three sub-pixels (Red, Green, and Blue) each with it's own switching transistor. Color selection can be based upon either row or column drive. Traditionally however, color selection is based on column drive. Video data from a video source is clocked into a shift register until one rows worth (i.e.: 640×3 sub-pixels for VGA graphics) has been accumulated. The data is then transferred in parallel to storage which also acts as a DAC for each column. Typically 3 bit and 6 bit DACs are employed. Row drivers select the row to be addressed. With 3 bits of grey-scale per color, 512 colors are available. This can be extended by one bit of temporal dither to 4096 colors. A further extension beyond 4096 colors can be introduced by software spatial dither. With 6 bits of grey scale per color, 262,144 colors are available, extended by software spatial dither. Light output is a function of back-light efficiency, polarization losses, cell aperture, and color filter transmission losses. Typically, transmission is only 4 percent efficient.

In a preferred embodiment of the present invention, color selection is performed by beam indexing. To facilitate such beam indexing, the line rate is 3 times faster than normal and the R, G, and B line is multiplexed sequentially. Alternatively, the frame rate may be 3 times faster than usual and field sequential color is employed. It should be appreciated that field-sequential scanning may produce objectionable visual effects to an observer moving relative to the display. Important features of a display of the present invention include the following.

1. Each pixel is generated by a single pixel well 70.
2. The color of a pixel is determined by a relative drive intensity applied to each of the three primary colors.
3. Phosphor 80 is deposited on faceplate 90 in stripes.
4. Primary colors are scanned via a beam index system which is synchronized to the grid control.
5. An electron beam is used to excite high voltage phosphors.
6. Grey-scale is achieved by control of the grid voltage at the bottom of each pixel well (and hence the electron beam density).
7. An entire row or column is addressed simultaneously.
8. If required, the least efficient phosphor 80, can be double scanned to ease grid drive requirements.
9. Phosphor 80, is held at a constant DC voltage.

The above features provide considerable advantages over conventional flat panel displays as will be described in the following, taking each in turn generally in the order presented above.

1. The pixel well concept reduces overall complexity of display fabrication.
2. Whereas in a CRT display, only about 11 percent of the electron beam current exits the shadow mask to excite the phosphor triads, in a display of the present invention the electron beam current at or near to 100 percent of the beam current is utilized for each phosphor stripe it is directed at by the beam indexing system. An overall beam current utilization of 33 percent is achievable, 3 times that achievable in a conventional CRT display.
3. Striped phosphors prevent Moire interference occurring in the direction of the stripes.
4. Control structures and tracks for the beam index system can be easily accommodated in a readily available area on top of the magnet, thereby overcoming a requirement for narrow and precise photolithography as is inherent in conventional LCDs.
5. High voltage phosphors are well understood and readily available.
6. The grid voltage controls an analog system. Thus the effective number of bits for each color is limited only by the DAC used to drive grid 40. Since only one DAC per pixel well row is involved, and the time available for digital to analog conversion is very long, higher resolution in terms of grey-scale granularity is commercially feasible. Thus, the generation of "true color" (24 bits or more) is realizable at relatively low cost.
7. As with conventional LCDs, a display of the present invention uses a row/column addressing technique. Unlike conventional CRT displays however, the excitation time of the phosphor is effectively one third of the line period, e.g.: between 200 and 530 times longer than that for a CRT display for between 600 and 1600 pixels per line resolution. Even greater ratios are possible, especially at higher resolutions. The reason for this is that line and frame flyback time necessary when considering conventional CRT display are not needed for displays of the present invention. The line flyback time alone for a conventional CRT display is typically 20 percent of the total line period. Furthermore front and back porch times are redundant in displays of the present invention, thereby leading to additional advantage. Further benefits include:
   (a) Only one driver per row/column is required (conventional color LCDs need three).
   (b) Very high light outputs are possible. In a conventional CRT display, the phosphor excitation time is much shorter than it's decay time. This means that only one photon per site is emitted during each frame scan. In a display of the present invention, the excitation time is longer than the decay period and so multiple photons per site are emitted during each scan. Thus, a much greater luminous output can be achieved. This is attractive both for projection applications and for displays to be viewed in direct sunlight.
   (c) The grid switching speeds are fairly low. It will be appreciated that, in a display of the present invention, the conductors formed on the magnet are operating in a magnetic field. Thus, the conductor inductance gives rise to an unwanted EMF. Reducing the switching speeds reduces the EMF, and also reduces stray magnetic and electric fields.
8. The grid drive voltage is related to the cost of the switching electronics. CMOS switching electronics offers a lower cost possibility, but CMOS level signals are also invariably lower than those associated with alternative technologies such as bipolar, for example. Double scanning, e.g., splitting the screen in half and scanning the halves in parallel, as is done in LCDs, thus provides an attractively low cost drive technology. Unlike in LCD technology however, double scanning in a display of the present invention doubles the brightness.
9. In low voltage FEDS, phosphor voltages are switched to provide pixel addressing. At small phosphor strip pitches, this technique introduces significant electric field stress between the strips. Medium or higher resolution FEDs may not therefore be possible without risk of electrical breakdown. In displays of the present invention however, the phosphors are held at a single DC final anode voltage as in a conventional CRT display. In preferred embodiments of the present invention, an aluminum backing is placed on the phosphors to prevent charge accumulation and to improve brightness. The electron beams are sufficiently energetic to penetrate the aluminum layer and cause photon emission from the underlying phosphor.

Figure 2:
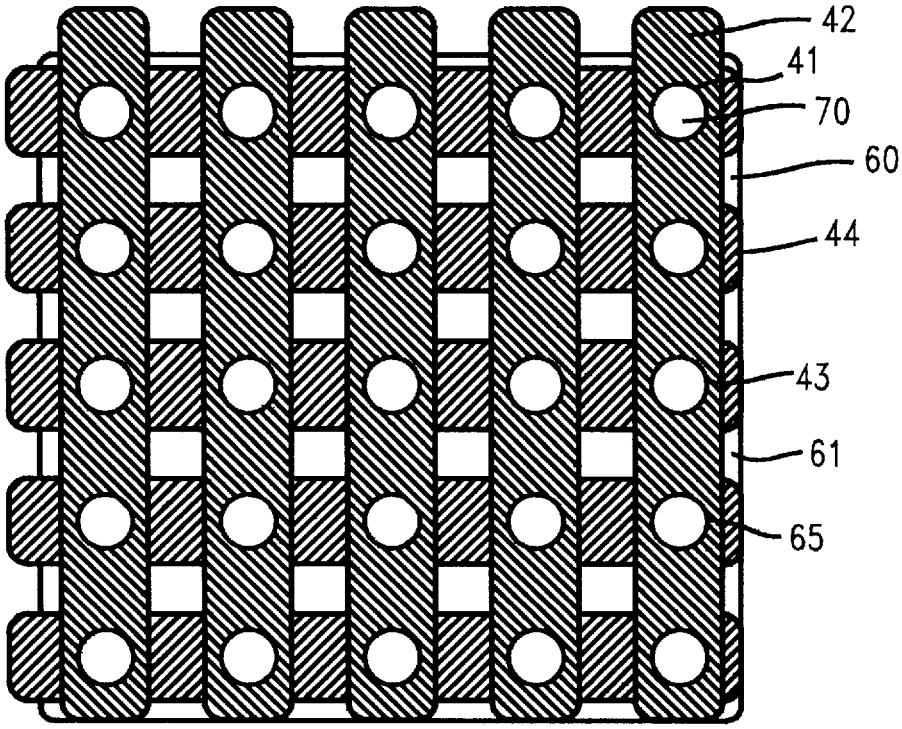
FIG. 2, illustrates a view of the underside or backside of the laminated magnet looking from the cathode plane.

FIG. 2, illustrates a view of the underside or backside 61, of the laminated magnet 60, looking from the plane of the cathode 20. As one can see that the hole or openings 41, in the column conductors 42, and the hole or openings 43, in the row conductors 44, are aligned with the hole or openings 65, of the magnet 60, to create the apertures or pixel wells 70.

Figure 3:
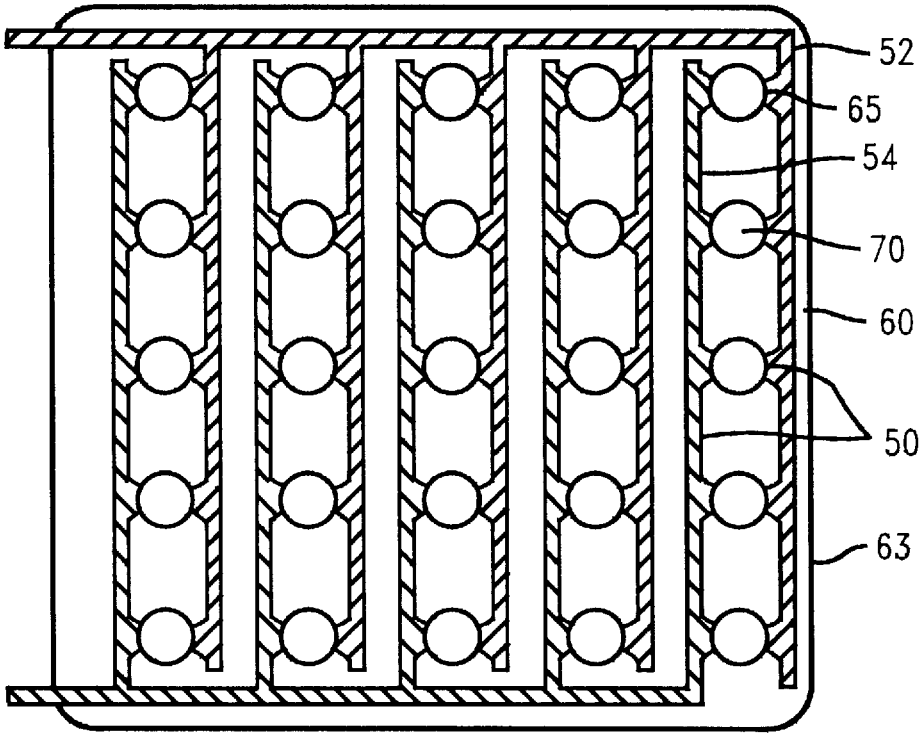
FIG. 3, illustrates a view of the topside or frontside of the laminated magnet looking from the plane of the final anode.

FIG. 3, illustrates a view of the topside or frontside 63, of the laminated magnet 60, looking from the plane of the phosphorus screen 80/90. As one can see that the anode 50, has a first deflection anode 52, and a second deflection anode 54. The first anode 52, steers or directs or deflects the electron beam 30, in one direction, while the second anode 54, steers or directs or deflects the electron beam 30, in the same or different direction.

Figure 4:
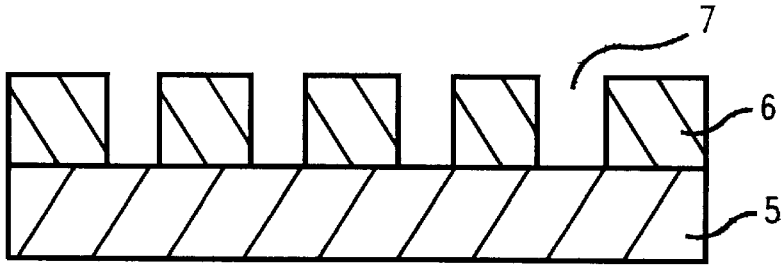
FIGS. 4–10, illustrate one process of manufacture of the preferred embodiment, specifically the laminated metal/ferrite magnet, of this invention.
Figure 5:
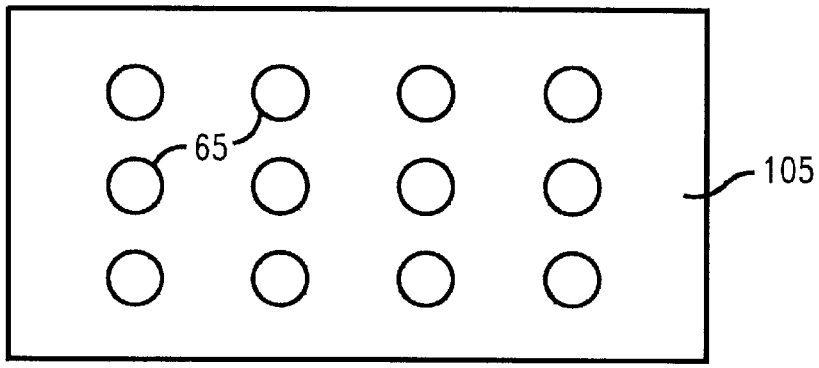

FIGS. 4–10, illustrate one process of manufacture of the laminated metal/ferrite magnet 60, of this invention. FIG. 4, shows a rolled metal sheet 5, which is preferably capable of withstanding oxidizing atmospheres of up to about 1000° C. Onto this metal sheet 5, is applied a photoresist 6, that is exposed and developed to produce a pattern of holes 7, in the resist 6. The metal sheet 5, and the developed photoresist 6, are then placed in an etchant that attacks the metal only in the area not protected by the resist 6. This produces the desired array of holes 65, in the metal sheet 5, creating the perforated metal sheet 105, as clearly seen in FIG. 5.

The photoresist 6, is then stripped from the metal sheet 105. The etched metal sheet 105, can now be inspected to ensure that all holes 65, are present and that the dimensional and positional tolerances of the holes are met.

For some applications the metal sheet 105, may have to be prepared to enhance the adhesion between it and the subsequent ferritic layer and/or dielectric layer. This could be accomplished by the deposition of or formation of selected adhesion promoting metals or oxides on one or both surfaces of the metal sheet 105. However, one could also use a suitable adhesive to secure the ferritic layer and/or dielectric layer to the metal sheet 105.

A ferritic layer 15, is formed by combining ferritic material with a glass powder, organic binders, solvents and vehicles to produce a slurry capable of being cast into thin ferritic sheets. The technology used to produce these thin ferritic sheets 15, is similar to the one used to prepare conventional multilayer ceramic greensheets. After drying, the cast sheets are cut to the proper size to form a ferritic layer 15, which are to be used for further processing.

In similar fashion, a dielectric layer 13, is formed by processing dielectric material(s) into a slurry and casting them to form thin dielectric greensheets 13. After drying, these cast sheets are also cut to the proper size to form the thin dielectric greensheets 13, which are to be used for further processing. The dielectric layer 13, can be formed by alternative techniques, such as, for example, oxidation of the surface of the metal sheet 105.

Figure 6:
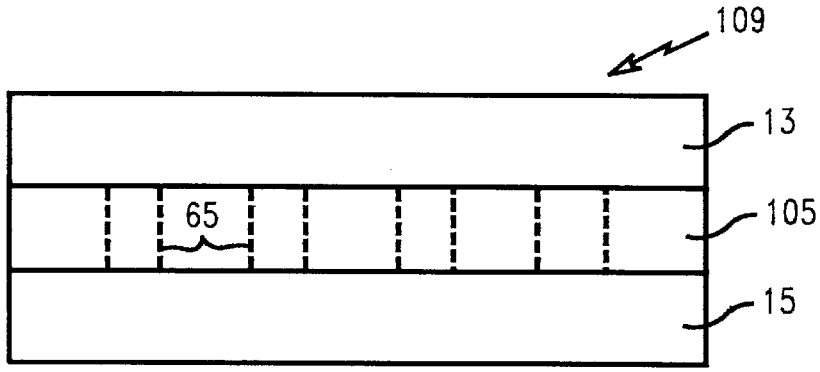

As shown in FIG. 6, a laminate structure is formed by combining the etched metal sheet 105, with the thin dielectric greensheet 13, on one side and the thin ferrite greensheet 15, on the other side, to form a primary "green" laminate structure 109. It is preferred that the laminate structure 109, is secured so that there is no movement between the various layers. This securing can be done by the simultaneous application of heat and/or pressure to all three components or layers of the laminate structure 109, or by adhesively bonding the layers to the metal sheet 105.

Figure 7:
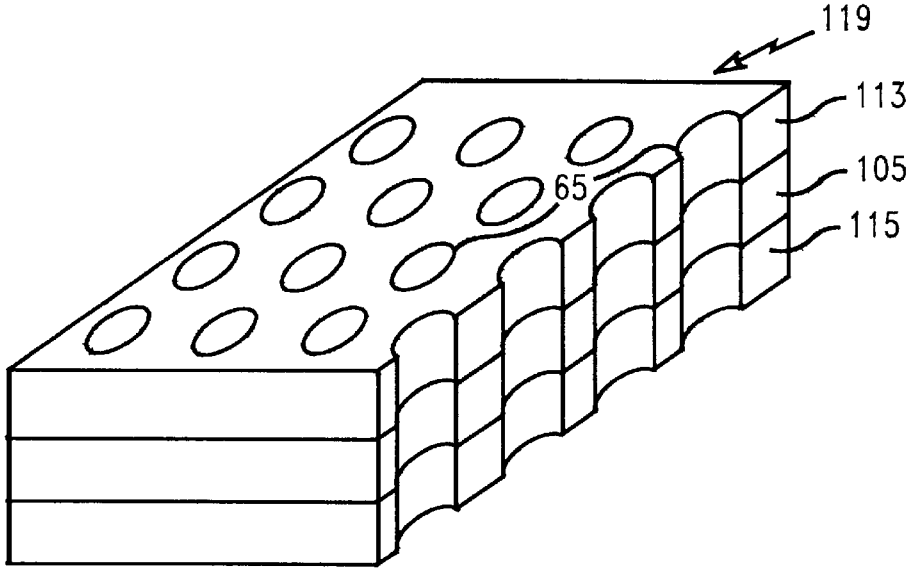
Figure 8:
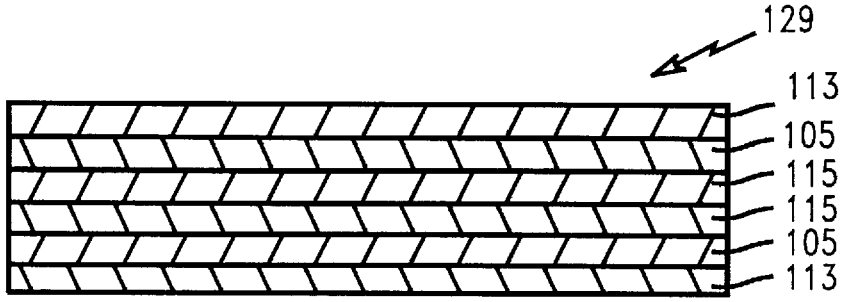

After the primary "green" laminate structure 109, has been formed, holes are produced in the ferritic greensheet 15, and dielectric greensheet 13, using the pre-existing etched holes 65, in the metal sheet 105, as a guide. The holes formed in the greensheet components of the laminate structure 109, can be made by myriad mechanical, laser, or electron beam techniques known to those skilled in the art. This is shown in FIG. 7, where a primary "green" laminate structure 109, has been perforated with holes 65, that have been produced in the ferritic greensheet 15, and dielectric greensheet 13, creating a punched ferritic greensheet 115, and a punched dielectric greensheet 113, that combine with the metal sheet 105, to form a perforated primary green laminate 119.

A plurality of perforated primary "green" laminate structures 119, may be combined into a secondary "green" laminate structure 129. This would be accomplished by the reapplication of heat and/or pressure to the components or by the use of an organic adhesive. In this step care must be taken to ensure the alignment of the holes 65, in the various substructures.

The secondary "green" laminate structure 129, is thermally processed in a manner that drives off or decomposes the organic constituents that may be present in the structure 129. This thermal process also coalesces the particles that are used to make up the ferritic and dielectric layers, it binds the ferritic layer 115, and the dielectric layer 113, to the metal sheet 105, and bonds the ferritic layers 115, to each other, as more clearly shown in FIG. 8. Please note that for the purpose of clarity through holes 65, have not been shown in the laminated structure 129, of FIG. 8.

The thermal processing of the secondary "green" laminate 129, is preferably done at a temperature less than that which will cause permanent deformation of the metal sheet 115. The glass phase added to the ferrite powder will enhance the sintering of the structure.

Figure 9:
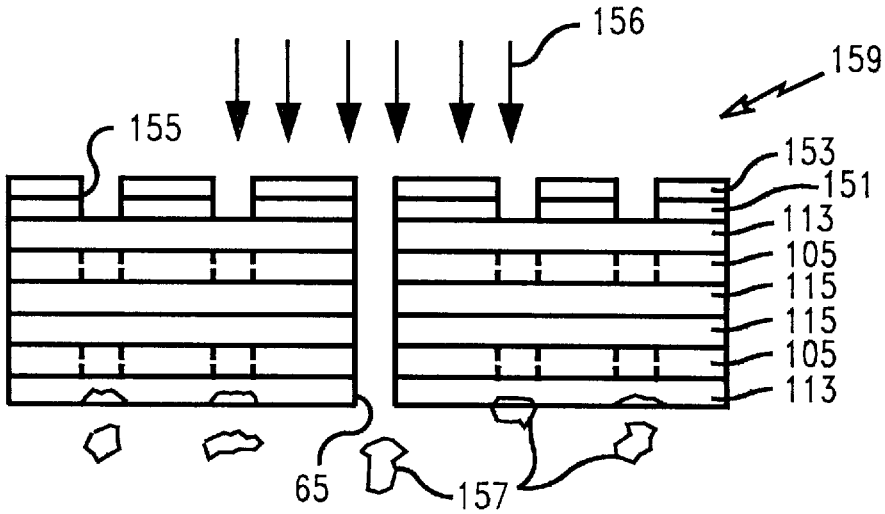

An alternative way of making the sintered laminate structure 129, is illustrated in FIG. 9, where the structure 109, as shown in FIG. 6, is stacked to create a structure 159. The stacked and laminated structure 159, is similar to the laminate structure 129, except that only holes 65, have been formed in the metal sheet 105, and that there are no holes 65, in the ferritic layer 115, or the dielectric layer 113. This structure 159, is then partially sintered to create a structure 159, which is essentially free of any organic material and is also partially densified. This partial densification of the laminated structure 159, should be such that a mechanical means could be used to form holes through the dielectric layer 113, and the ferrite layer 115. One way to form the hole 65, would be by using a media blast or pressurized impinging medium 155. Care should be taken that the laminated structure 159, is not damaged in any way. One way to avoid any damage to the laminated structure 159, would be to secure a metal or coated metal-type plate 151, having openings 155, that correspond to the openings 65, to the side of the laminated structure 159, that is being hit with the impinging medium 156. The metal-type plate 151, could also have a polymer or rubber backing 153, having openings 155. Particles from the media blast 156, that pass through the openings 155, hit the particles in the vicinity of the openings 65, and that results in the expulsion of particles 157, thus creating openings 65, in both the dielectric layer 113, and the ferrite layer 115, resulting in a laminated structure 129, that has through openings 65. The laminated structure 129, having through openings 65, can now be fully sintered, if it has not been done so.

After the sintered laminate structure 129, has been formed, the anodes 52 and 54, and the first set of control grid electrodes 42 or 44, are applied to or formed on the structure, as clearly shown in FIG. 10.

These electrically conductive metal patterns, such as, metal patterns 42, 44, 52 and 54, may be applied by any of a number of techniques that include the screen printing of metal pastes, the photo or mechanical patterning of applied metal layers, or the application of a pre-patterned metal decal. Depending on the techniques used to apply the metal patterns, a subsequent heat treatment of the laminate structure may be required.

In order to form the metal patterns 42 and 44, it is preferred that after the application of the initial metal pattern say 42, to the surface of the sintered laminate structure 129, a second set of control grid electrodes 44, may be applied orthogonally to the first set 42 or 44, because it does not matter if grid electrode 42, is formed first or the grid electrode 44, is formed first. However, prior to the application of the second set of control grid electrodes, a dielectric layer 121, may be deposited onto the first set of electrodes, lets say electrode 42, to isolate one electrode from the other electrode. This dielectric layer 121, may be applied in the form of an adhesively bonded greensheet, it may be made into a slurry that is sprayed onto the surface, or it may be applied using conventional thin film deposition techniques, which are well known in the art.

Depending on the technique used to apply the dielectric layer 121, the sintered laminate 129, may have to be subjected to another heat treatment to coalesce the powders of the dielectric layer. Imperative in this step is that the holes 41, 43 and 65, forming the pixel hole 70, in the structure not be altered by the application of the dielectric layer 121. Once the dielectric layer 121, has been applied to the surface of the sintered laminate, over the first set of control grid electrodes, the second set of control grid electrodes may be applied orthogonally to the first.

The application of these metal features would utilize any of the techniques previously described for the application of surface metallization.

However, it should be noted that all of the metal and dielectric features could be applied in an unsintered pre-patterned form to the sintered laminate. A second sintering would then bond these features to the initial laminate structure.

After the final sintered laminate 60, has been produced, it would be subjected to electrical test, physical inspection, and finally the polarizing of the ferritic layers 115, to produce the necessary magnetic field. It should be appreciated that polarization of the ferritic layers 115, can take place before or after assembly of the magnet laminate 60, in a device. Furthermore, the polarization of the ferritic layers 115, can also take place at elevated temperatures.

One advantage of the magnet laminate 60, of the present invention is that the openings 65, or the pixel wells 70, do not have to be perfectly aligned in order for the electron beam 30, to pass through the pixel wells 70.

The metal plate(s) 105, that is part of the magnet laminate 60, provides numerous advantages. For example, the metal plate avoids charging and acts as a stray electron sink. It provides mechanical strength to the magnet laminate 60. It provides thermal stress gradient reduction. The metal plate (s) provide dimensional stability. They are used for the process registration for the hole formation. For some applications the metal plate(s) 105, could also be used as a mask for the formation of phosphors on the glass plate.

For the ease of understanding the preferred embodiment has been described using color phosphor strips 80, however, this invention is also applicable to any monochrome type technology. It should also be appreciated that the phosphor 80, does not have to be a strip 80, for this invention to work, for example, one could have phosphor dots 80, or phosphor pixels 80, to name a few.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A process of forming metal/ferrite laminate magnet, comprising the steps of:

(a) forming at least one opening in a metal sheet having a first surface and a second surface, (b) securing at least one ferritic layer to said first surface of said metal sheet, (c) securing at least one dielectric layer to said second surface of said metal sheet, (d) forming an opening through said ferritic layer and said dielectric layer, such that at least a portion of said opening overlaps a portion of said opening in said metal sheet, and thereby forming said metal/ferrite laminate magnet.

2. The process of claim 1, wherein said at least one opening in said metal sheet is formed by the application of at least one photoresist on said metal sheet, exposing and developing said photoresist to form a pattern of holes, and subsequently etching said metal sheet to form said at least one opening in said metal sheet.

3. The process of claim 1, wherein said at least one opening in said metal sheet is formed by a laser beam, an electron beam or mechanical means.

4. The process of claim 1, comprising mixing ferritic material with glass particles, organic binders and solvents to form a ferritic slurry; mixing, casting and drying said ferritic slurry, into a ferritic green sheet; and blanking said ferritic green sheet into said at least one ferritic layer.

5. The process of claim 1, comprising mixing dielectric material to form a dielectric slurry; mixing, casting and drying said dielectric slurry, into a dielectric green sheet; and blanking said dielectric green sheet into said at least one dielectric layer.

6. The process of claim 1, wherein said at least one ferritic layer is secured to said first surface of said metal sheet by application of heat and/or pressure.

7. The process of claim 1, wherein said at least one ferritic layer is secured to said first surface of said metal sheet by application of at least one adhesive.

8. The process of claim 1, wherein said at least one dielectric layer is secured to said second surface of said metal sheet by application of heat and/or pressure.

9. The process of claim 1, wherein said at least one dielectric layer is secured to said second surface of said metal sheet by application of at least one adhesive.

10. The process of claim 1, wherein at least one electrically conductive metal is secured adjacent to said opening.

11. The process of claim 1, further comprising securing at least one anode means on said perforated face of said magnet.

12. The process of claim 1, further comprising securing at least one control grid means on said face of said magnet remote from said face carrying an anode means.

13. The process of claim 12, wherein said anode means and said control grid means are deposited using a process selected from a group comprising, photolithography, screen printing, decal transfer, plating, or adhesive patterning followed by dry deposition of at least one electrically conductive medium.

14. The process of claim 1, wherein cross-section of said opening is selected from a group comprising circular cross-section, polygonal cross-section, triangular cross-section or rectangular cross-section.

15. The process of claim 1, wherein said opening in said ferritic layer is formed by partially sintering said ferritic layer and using a pressurized impinging medium to open at least one hole.

16. The process of claim 1, wherein two of said metal/ferrite laminate magnet are secured to each other such that said metal sheet sandwiches said ferritic material and said dielectric material is on the opposite sides.

17. The process of claim 1, comprising mixing ferritic material with glass particles, organic binders and solvents to form a ferritic slurry, and wherein said ferritic slurry is deposited onto said metal sheet using at least one spray.

18. The process of claim 1, comprising mixing dielectric material to form a dielectric slurry, and wherein said dielectric slurry is deposited onto said metal sheet using at least one spray.

19. The process of claim 1, comprising heating said metal sheet to at least 300° C. and depositing dry ferritic powder material onto said heated metal sheet until at least one coating of said ferritic material is formed on said metal sheet.

20. The process of claim 1, comprising heating said metal sheet to at least 300° C. and depositing dry dielectric powder material onto said heated metal sheet until at least one coating of said dielectric material is formed on said metal sheet.

21. The process of claim 1, wherein at least one adhesive is applied onto said metal sheet and at least one layer of dry ferritic powder material is adhered onto said metal sheet using said at least one adhesive.

22. The process of claim 1, wherein at least one adhesive is applied onto said metal sheet and at least one layer of dry dielectric powder material is adhered onto said metal sheet using said at least one adhesive.

23. The process of claim 1, wherein at least one surface of said metal sheet is oxidized to form at least one dielectric layer.

24. The process of claim 1, wherein said metal sheet is an electron sink for any stray electrons.

25. The process of claim 1, wherein said metal sheet is a heat spreader to minimize any thermal gradients.

26. The process of claim 1, wherein said metal sheet prevents any distortion of said laminate magnet.

27. The process of claim 1, wherein said metal sheet is used as a mask to form at least one layer of phosphor on at least one screen.

28. The process of claim 1, wherein said laminate magnet is used as a mask to form at least one layer of phosphor on at least one screen.

29. The process of claim 1, wherein said hole in said metal sheet is used to form corresponding holes in subsequent components of said laminate magnet, and wherein all of said correspondingly formed holes are held in registration with said hole in said metal sheet.

30. A process for making a display device comprising: making an electron source according to said process claimed in claim 1, positioning a phosphor coated screen adjacent said face of said magnet carrying an anode means, and, evacuating spaces between said electron source and between said magnet and said screen.

* * * * *